United States Patent [19]

Steiner et al.

[11] Patent Number: 4,558,195

[45] Date of Patent: Dec. 10, 1985

[54] APPARATUS AND METHOD FOR SENSING HIGH AND LOW LIQUID LEVEL TO CONTROL A CIRCUIT

[75] Inventors: Charles W. Steiner, Brooklyn Park; René D. Sovia, Forest Lake, both of Minn.

[73] Assignee: The Marley-Wylain Company, Mission Woods, Kans.

[21] Appl. No.: 565,202

[22] Filed: Dec. 23, 1983

[51] Int. Cl.[4] ..... H01H 35/40

[52] U.S. Cl. ..... 200/83 R; 200/83 N

[58] Field of Search ..... 200/83 R, 83 J, 83 N, 200/83 P, 84 C; 417/38, 40

[56] References Cited

U.S. PATENT DOCUMENTS

| | | | |
|---|---|---|---|
| 2,406,719 | 8/1946 | Upson | 200/83 N |
| 3,268,683 | 8/1966 | Palmer | 200/83 N |
| 3,424,883 | 1/1969 | Heskett | 200/83 B X |
| 3,760,396 | 9/1973 | Haselton | 200/83 N X |
| 4,000,386 | 12/1976 | Brouwer | 200/83 N X |
| 4,127,360 | 11/1978 | Carpenter | 200/83 N X |

*Primary Examiner*—J. R. Scott

*Attorney, Agent, or Firm*—Merchant, Gould, Smith, Edell, Welter & Schmidt

[57] ABSTRACT

The present invention is directed to apparatus for sensing high and low liquid level for the purpose of controlling a circuit. As liquid rises, gas within a first communicating line to a differential pressure switch is relieved through a check valve to atmosphere. When the liquid rises sufficiently, the pressure within a second communicating line causes closure of the switch and the circuit. As the level of liquid recedes, the check valve closes and a vacuum develops in the first connecting line so that the switch and circuit remain closed until the liquid level is below the entry to the first communicating line. At that time, the liquid within the communicating line exits and the pressures are equalized to the switch which then opens thereby opening the circuit.

6 Claims, 3 Drawing Figures

APPARATUS AND METHOD FOR SENSING HIGH AND LOW LIQUID LEVEL TO CONTROL A CIRCUIT

FIELD OF THE INVENTION

The present invention is directed to apparatus for sensing high liquid level in order to switch on a circuit, such as a pump drive circuit, and hold such circuit on until a low liquid level is sensed whereupon said circuit is turned off. The present invention is further directed to the method of operation and use for the apparatus.

BACKGROUND OF THE INVENTION

Various devices for sensing liquid level are known. Most such devices are a part of a switching mechanism for controlling a motor and pump. In addition, most such devices use a float of some kind which starts the motor and pump when the float has risen a predetermined distance and which stops the motor and pump when it subsequently goes down a predetermined distance. Exemplary patents include U.S. Pat. No. 3,316,845, U.S. Pat. No. 3,941,073, U.S. Pat. No. 4,081,639, U.S. Pat. No. 4,186,419 and U.S. Pat. No. 4,345,879.

The float sensor/switches function well, but are relatively expensive and are subject to hanging up and replacement because of various defects inherent in particular designs. The concept, however, has been used for years which is probably the reason why simpler and more reliable mechanisms such as the present invention have not been identified.

SUMMARY OF THE INVENTION

The present invention is directed to apparatus for sensing high and low liquid level to control a circuit. The apparatus includes first and second mechanisms for communicating liquid between first and second ends. The first end of the first communicating mechanism is elevationally lower than the first end of the second communicating mechanism. The first communicating mechanism furthermore includes a check valve between the first and second ends in order to relieve over-ambient pressure to ambient. The apparatus also includes switch mechanism for sensing a higher fluid pressure at the second end of the second communicating mechanism as compared to the second end of the first communicating mechanism. The switch mechanism closes a circuit when the indicated higher pressure is sensed.

More particularly, a preferred embodiment uses a diaphragm switch having first and second chambers on either side of the diaphragm. First and second tubes are connected at one end to a different one of the two chambers. The open ends of the tubes have inverted cups attached thereto. The cups have larger cross-sectional flow diameters than the cross-sectional diameter inside each of the tubes. Also, the first cup is larger and is placed at a lower elevation than the second cup. In addition, in the tube leading to the first cup, a check valve is included in order to release over-ambient pressure to ambient on one side of the switch as water or another liquid rises. In that fashion, one side of the diaphragm experiences a higher pressure thereby forcing the diaphragm to deflect and close a circuit. If a motor driving a pump is in the circuit, the pump frequently is located so as to reduce the level of the water or liquid. Even though the liquid recedes below the elevational level of the entry of the inverted second cup, a vacuum in the tube connected to the inverted first cup holds the diaphragm deflected and the switch closed until liquid recedes below the entry to the first cup. Liquid held within the first cup is then released, the vacuum is lost, and the switch opens.

The present invention is particularly important because of its simplicity and, consequent, inexpensive cost. Furthermore, the present invention is extremely advantageous for use in all types of pumping situations wherein liquid level must be maintained within a range. The higher liquid level is readily determined with appropriate testing and depends on the internal volume within the inverted second cup, the fluid communicating tube, and the chamber within the switch and also depends on the amount of pressure differential necessary for functioning the switch mechanism. The lower level is determined by placement of the entry to the first inverted cup attached to the communicating tube having the check valve therein.

These advantages and other objects obtained by this invention are further explained and may be better understood by reference to the drawings and descriptive matter hereinafter. In these materials, a preferred embodiment of the invention is illustrated and described in detail.

BRIEF DECRIPTION OF THE DRAWINGS

DETAILED DESCRIPTION OF THE PREFERRED EMBODIMENT

Figure 1:
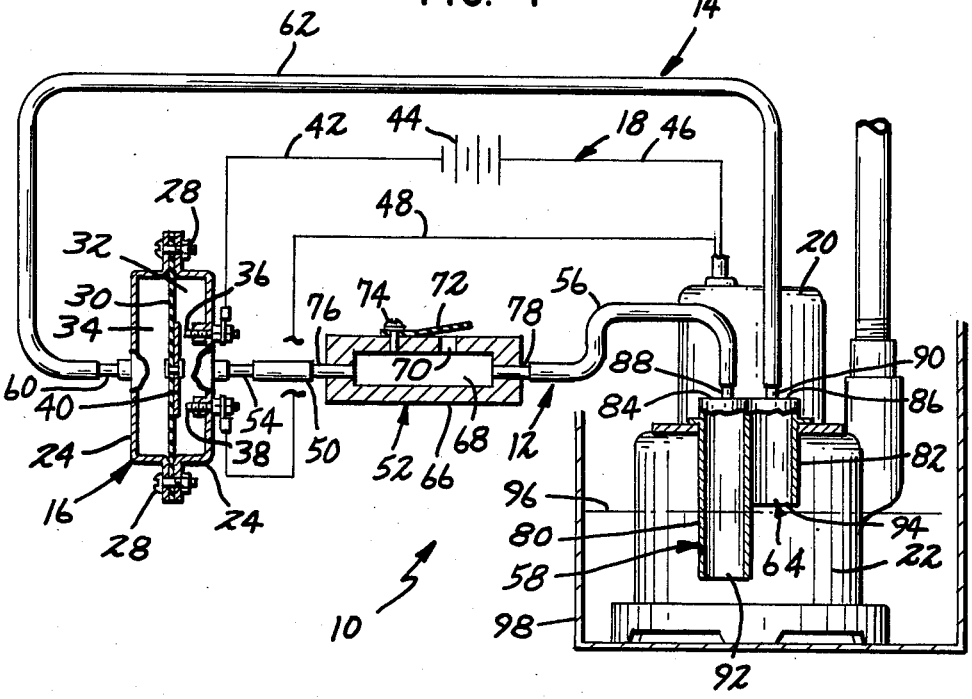
FIG. 1 is an illustration, with some elements shown in cross section, of apparatus in accordance with the present invention wherein the liquid level is rising and is between the entry to first and second communication mechanisms.

Referring now to the drawings wherein like reference numerals designate identical or corresponding parts throughout the several views, and more particularly to FIG. 1, an apparatus in accordance with the present invention is designated generally by the numeral 10. Apparatus 10 senses predetermined high and low liquid levels to control a circuit. It does this by comparing pressures within a pair of fluid communicating mechanisms 12 and 14. When a differential pressure at switch device 16 is sensed, circuit 18 is closed thereby causing motor 20 and pump 22 to operate.

Switch 16 may be typically a diaphragm operated switch wherein a pair of flanged, open ended box members 24 and 26 are fastened together with, for example, nut and bolt combinations 28 to hold a diaphragm 30 between them. Diaphragm 30 defines a first chamber 32 on one side and a second chamber 34 on the other side of it. A pair of contacts 36 and 38 protrude through a wall of box member 26 into first chamber 32. Connecting contact 40 is attached to diaphragm 30 to meet contacts 36 and 38 when diaphragm 30 deflects toward contacts 36 and 38.

Contact 36 is connected via line 42 to a power source 44 which is connected via line 46 to motor 20. The other contact 38 is connected via line 48 to motor 20 to complete the electrical circuit 18.

First communicating mechanism 12 includes a tube 50 connected between a check valve 52 and a nipple 54 which provides fluid communication into chamber 32 of switch 16. The other side of check valve 52 is connected with a tube 56 to an inverted cup 58. Similarly, chamber 34 of switch device 16 is connected by nipple 60 to tube 62 which connects with inverted cup 64.

Check valve 52 is any type which allows fluid having over-ambient pressure to escape to the ambient atmosphere. As shown in the illustration, a representative check valve 52 has a housing 66 with an internal cavity 68. A passage 70 leads from cavity 68 to the atmosphere. A flapper 72 is attached with a screw 74 so as to cover passage 70 when the pressure inside check valve 52 is equal to or less than the pressure outside. Check valve 52 further includes, for example, a pair of nipples 76 and 78 to which tubes 50 and 56 connect.

Inverted cups 58 and 64 provide a volume into which liquid may rise so that the captured air or gas is forced upwardly and compressed in the tubes of first and second communicating mechanisms 12 and 14. Inverted cups 58 and 64 may be simply an enlarged end portion of tubes 56 and 62, i.e., the internal diameter of the end portions of tubes 56 and 62 would be larger than the internal diameter of the tubes themselves. As shown in the illustration, the inverted cups 58 and 64 are separate from tubes 56 and 62, and have internal diameters larger than the tubes. Cups 58 and 64 may be, for example, pipes 80 and 82 with the top end closed with plates 84 and 86 with each having a nipple 88 and 90 for connection to tubes 56 and 62. Inverted cup 58 has a larger internal volume than inverted cup 64 and has an entry 92 at a lower elevation than the entry 94 of cup 64.

Figure 2:
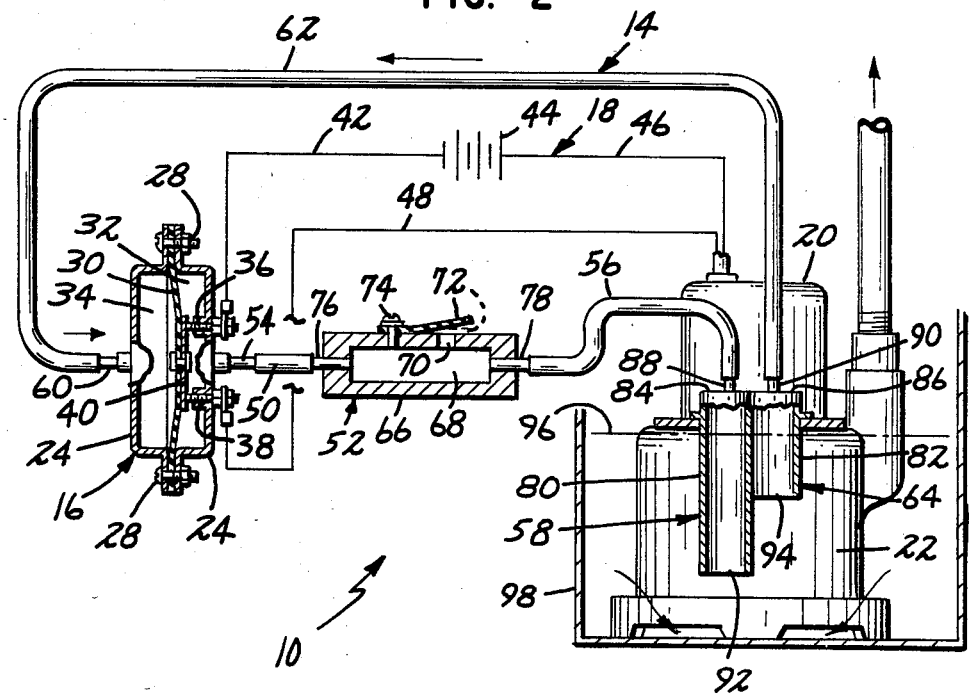
FIG. 2 is similar to FIG. 1 except the liquid level is elevationally above the entry to both communication mechanisms.
Figure 3:
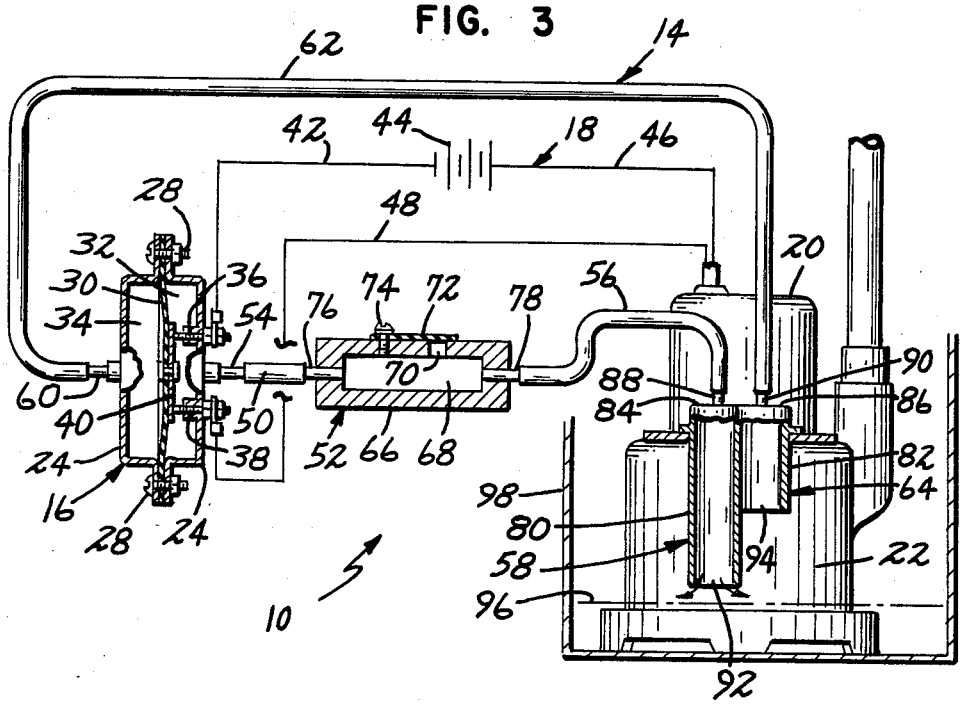
FIG. 3 is an illustration similar to FIGS. 1 and 2, except the liquid level has just receded below the entry to the second communication mechanism.

In operation, FIG. 1 shows the liquid level at line 96 in container 98. The liquid is rising and its level 96 is above entry 92 to cup 58 of first communicating mechanism 12. As level 96 rises, air or gas in first communicating mechanism 12 is forced toward check valve 52 and to prevent a pressure buildup, flapper 72 opens thereby allowing air or gas to escape. As shown in FIG. 2, when level 96 rises above entry 94 to cup 64 of second communicating mechanism 14, the gas pressure in second communicating mechanism 14 increases and at a predetermined level, diaphragm 30 of switch 16 flexes sufficiently so that connecting contact 40 provides circuit closure through contacts 36 and 38 of circuit 18. Motor 20 then starts and as shown in the illustration pump 22 begins pumping liquid. As soon as level 96 begins to recede, flapper 72 of check valve 52 closes passage 70 and a vacuum begins to develop in first communicating mechanism 12. The vacuum holds connecting contact 40 in its closure position until, as shown in FIG. 3, the level 96 of liquid recedes below entry 92 of cup 58. At that point, the liquid in cup 58 falls from cup 58 to break the vacuum thereby equalizing pressure in first and second communicating mechanisms 12 and 14 and also in chambers 32 and 34 of switch 16. Therefore, diaphragm 30 flexes to its normal position to break circuit contact and turn off motor 20.

It is understood that FIGS. 1–3 are illustratively conceptual. The circuit 18 is representative of a type of circuit which may be controlled with apparatus 10. Cups 58 and 64 may be fashioned in a variety of ways and, although shown side by side, they may be widely separated. It is only necessary that cup 58 have an entry 92 at a lower elevation than entry 94 of cup 64. Although it is not necessary, it is preferred that the volume of cups 58 and 64 be large relative to the internal volume of the connecting elements with switch 16. It is also preferred that the internal volume of cup 64 be less than the internal volume of cup 58. Check valve 52 and switch 16 are typical of the types of devices which may be used for the indicated functions. Nevertheless, there are a wide variety of similar devices which may be used very effectively.

To summarize, the advantages and details of structure and function as set forth are considered exemplary. Although the preferred embodiment presented is representative of the present concept, the disclosure is illustrative. Consequently, changes made, especially in matters of shape, size, arrangement and types of particular components, to the full extent extended by the general meaning of the terms in which the appended claims are expressed, are within the principle of the present invention.

What is claimed is:

1. Apparatus for sensing high and low liquid level in a reservoir where liquid rises and falls, said apparatus for controlling an electrical circuit, said apparatus comprising:

first and second means for communicating fluid between first and second ends, the first ends being open and located in said reservoir, the first end of said first communicating means being elevationally lower than the first end of said second communicating means, said first communicating means including a check valve between the first and second ends, said check valve relieving over-ambient pressure to ambient; and switch means for sensing a higher fluid pressure in said second communicating means than in said first communicating means, the second ends of said first and second communicating means being connected to said switch means, said check valve and said switch means being located above the liquid level, said switch means closing said circuit when said higher pressure is sensed;

whereby as liquid rises in said reservoir to enter the first ends of both said first and second communicating means, pressure in said first communicating means is relieved to ambient through said check valve while higher fluid pressure in said second communicating means creates a differential pressure across said switch means to function said switch means from a first state to a second state, said switch means functioning from said second state back to said first state when liquid falls beneath the first end of said first communicating means.

2. Apparatus in accordance with claim 1 wherein said switch means includes a housing with first and second chambers separated by a diaphragm, said switch means further including means connected to said diaphragm for closing the electrical circuit on flexing of said diaphragm due to differential pressure between said first and second chambers.

3. Apparatus in accordance with claim 1 wherein said first and second communicating means includes first and second inverted cups at the first ends of said first and second communicating means, respectively, said first communicating means including a first tube connected to said first cup and said second communicating means including a second tube connected to said second cup, said first and second cups having diameters greater than said first and second tubes.

4. Apparatus in accordance with claim 3 wherein said first cup has volume greater than said second cup.

5. Apparatus for sensing high and low liquid level to control an electrical circuit said apparatus comprising:

a differential pressure switch having a diaphragm between first and second chambers;

first means for communicating a fluid through a first tube between a first end portion and the first chamber of said switch, the first end portion of said first communicating means having a larger cross-sectional flow area than said first tube, said first communicating means further including a check valve between the first end portion and the first chamber, said check valve relieving over-ambient pressure in said first tube to ambient pressure outside said first tube;

second means for communicating a fluid through a second tube between a second end portion and the second chamber of said switch, the second end portion of said second communicating means having a larger cross-sectional flow area than said second tube, the second end portion of said second communicating means being elevationally higher and smaller in volume than the first end portion of said first communicating means;

whereby rising liquid causes greater air pressure in said second communicating means than in said first communicating means thereby flexing said diaphragm and closing said switch, the differential pressure between said first and second communicating means being maintained by vacuum within said first communicating means as liquid recedes below the second end portion until the liquid recedes below the first end portion thereby exposing both said first and second communicating means to ambient pressure.

6. The method of switching an electrical circuit, comprising the steps of:

relieving to ambient gas being forced through first fluid communicating means by a rising liquid;

compressing gas due to said rising liquid within second fluid communicating means, said second fluid communicating means having an entry at a higher elevation than an entry to said first communicating means;

sensing the difference in gas pressure between said first and second communicating means and closing said circuit;

maintaining said circuit closed as liquid recedes below the entry to said second fluid communicating means; and opening said circuit when said liquid recedes below the entry to said first fluid communicating means.

* * * * *